US008783377B2

(12) United States Patent
Baumann et al.

(10) Patent No.: US 8,783,377 B2
(45) Date of Patent: Jul. 22, 2014

(54) HAND-HELD POWER TOOL, PARTICULARLY A ROTARY AND/OR CHISEL HAMMER, HAVING A VIBRATION ABSORBING UNIT

(75) Inventors: Otto Baumann, Leinfelden-Echterdingen (DE); Hardy Schmid, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 347 days.

(21) Appl. No.: 12/808,933

(22) PCT Filed: Oct. 17, 2008

(86) PCT No.: PCT/EP2008/064044

§ 371 (c)(1), (2), (4) Date: Jun. 17, 2010

(87) PCT Pub. No.: WO2009/077228

PCT Pub. Date: Jun. 25, 2009

(65) Prior Publication Data

US 2010/0307783 A1 Dec. 9, 2010

(30) Foreign Application Priority Data

Dec. 17, 2007 (DE) ..... 10 2007 060 636

(51) Int. Cl.
*E21B 1/38* (2006.01)

(52) U.S. Cl.
USPC ..... 173/1; 173/162.1

(58) Field of Classification Search
USPC ..... 173/162.1, 162.2, 211, 200; 188/290, 188/295, 296, 378, 379, 380; 267/137
See application file for complete search history.

(56) References Cited

U.S. PATENT DOCUMENTS

| | | | | |
|---|---|---|---|---|
| 3,028,841 | A | 4/1962 | Leavell | |
| 3,291,224 | A * | 12/1966 | Stutz | 173/49 |
| 3,682,254 | A * | 8/1972 | Hoeffleur | 173/49 |
| 4,257,648 | A * | 3/1981 | Bodine | 299/37.2 |
| 4,478,293 | A * | 10/1984 | Weilenmann et al. | 173/162.2 |
| 4,991,664 | A * | 2/1991 | Kolgan et al. | 173/201 |
| 5,025,870 | A * | 6/1991 | Gantner | 173/162.2 |
| 5,988,329 | A * | 11/1999 | Evans et al. | 188/296 |
| 2006/0076154 | A1 | 4/2006 | Aoki | |
| 2006/0289185 | A1 | 12/2006 | Hahn | |

FOREIGN PATENT DOCUMENTS

| | | | |
|---|---|---|---|
| CN | 1533866 | A | 10/2004 |
| CN | 1883885 | A | 12/2006 |
| EP | 1464449 | A2 | 10/2004 |
| EP | 1736283 | A2 | 12/2006 |
| SU | 138909 | | 11/1960 |
| WO | 8802076 | A1 | 3/1988 |
| WO | 2008140030 | A2 | 11/2008 |

* cited by examiner

*Primary Examiner* — Thanh Truong
*Assistant Examiner* — Nathaniel Chukwurah
(74) *Attorney, Agent, or Firm* — Maginot, Moore & Beck

(57) ABSTRACT

A hand-held power tool, in particular an impact driver, an impact drill, or a rotary hammer, is proposed, which has a drive unit and/or output with at least one line of action, which produces at least oscillations along the line of action. In order to reduce these oscillations, the hand-held power tool is equipped with at least one vibration absorber unit. The vibration absorber unit has at least one mobile vibration absorbing element, which has at least one degree of freedom of movement. This degree of freedom of movement encloses at least one angle not equal to zero with the line of action.

15 Claims, 8 Drawing Sheets

HAND-HELD POWER TOOL, PARTICULARLY A ROTARY AND/OR CHISEL HAMMER, HAVING A VIBRATION ABSORBING UNIT

CROSS-REFERENCE TO RELATED APPLICATION

This application is a 35 USC 371 application of PCT/EP2008/064044 filed on Oct. 17, 2008.

BACKGROUND OF THE INVENTION

1. Field of the Invention

The invention relates to a hand-held power tool, in particular an impact driver, an impact drill, or a rotary hammer, having at least one drive unit and/or output. The drive unit and/or output has at least one line of action, which is defined in a rotary hammer, for example, by the axial action direction of an impact mechanism. At least along this line of action, the drive unit and/or output produces oscillations, which can be transmitted in the form of vibrations to a housing and/or handle of the power tool. Users of the power tool find these vibrations unpleasant. In order to reduce these oscillations/vibrations, the power tool is equipped with at least one vibration absorber unit.

2. Description of the Prior Art

A variety of hand-held power tools with vibration absorber units for reducing oscillation are already known. Among others, EP 1 252 976 A1 has disclosed a vibration absorber unit, which, when used in hand-held power tools operated in a hammering mode such as rotary and/or chisel hammers, exerts a damping action on vibrations that propagate along a main oscillation axis extending parallel to the line of action of an impact mechanism. To this end, EP 1 252 976 A1 uses a so-called inertial vibration absorber that has a vibration absorbing element, which is supported so that it is able to move in an axial direction parallel to the line of action of the impact mechanism between two return springs. In this case, the vibration absorbing element is embodied as a mass element, also referred to as a vibration absorbing mass. By means of this arrangement, the vibration absorbing element functions as a counter-oscillator, which is displaced from a rest position by the oscillations propagating along the line of action and follows the oscillations in a delayed fashion due to its inertia. The return springs in turn damp the displacements of the vibration absorbing element, thus drawing energy from the oscillations. Because of their embodiment as a mass/spring system, vibration absorber units of this kind preferably act on a narrowly delimited frequency spectrum.

In addition, EP 1 439 038 A1 and EP 1 464 449 A2 among others have disclosed vibration absorbing systems that are actuated by different driving mechanisms. In these arrangements, the driving mechanisms couple the axially mobile vibration absorbing element to the drive unit and/or output producing the oscillations. These vibration absorbing systems, however, are also situated so that the vibration absorbing element moves axially along an axis parallel to the line of action of the drive unit and/or output.

In hand-held power tools, which in addition to an impact drive, also have a rotary drive for the tool, vibrations do not occur only in the axial direction, i.e. parallel to the line of action of the impact mechanism. In particular, rotatory vibrations occur due to the recoiling of a tool that is driven at least in rotary fashion during the machining of a work piece. In addition, in hand-held power tools in which the center of mass is situated far away from a tool axis, tilting moments occur, which excite vibrations transverse to the impact direction.

ADVANTAGES AND SUMMARY OF THE INVENTION

The hand-held power tool according to the invention, has at least one drive unit and/or output, which has at least one line of action. In hand-held power tools operated in a hammering fashion, the line of action is defined by a movement axis of an impact mechanism; the line of action is also referred to here as the impact axis. The hand-held power tool according to the invention also has at least one vibration absorber unit for reducing oscillations produced by the drive unit and/or output. The vibration absorber unit has at least one mobile vibration absorbing element. The vibration absorbing element according to the invention has at least one degree of freedom, which encloses at least one angle W1 not equal to zero with the line of action. Through this arrangement, the vibration absorber unit is also able, in a structurally simple way, to damp oscillation modes that propagate in nonparallel fashion in relation to the line of action of the drive unit and/or output.

A preferred embodiment of the vibration absorber unit has additional degrees of freedom, in particular in three dimensions and/or with regard to rotation. In a particularly inexpensive way, this broadens the action of the vibration absorber unit to other oscillation modes in the vibration spectrum of the hand-held power tool according to the invention.

A particularly simple embodiment of a vibration absorber unit according to the invention is achieved in that a degree of freedom of the mobile vibration absorbing element is embodied as a transverse movement. In this case, it must be viewed as an additional advantage that the vibration absorbing element of the vibration absorber unit according to the invention has two orthogonal movement components, the one movement component extending parallel to the line of action and the other movement component extending orthogonal to the main oscillation axis. In this way, parallel and orthogonal oscillation modes can be damped with a single vibration absorber unit.

If the vibration absorber unit according to the invention has at least one rotatory degree of freedom of movement, which corresponds to a rotational movement in a movement plane around a rotation axis, then a particularly compact design of the vibration absorber unit can be achieved in a particularly simple way. A vibration absorber unit of this kind also exerts its action particularly on rotatory oscillation modes in the vibration spectrum of the hand-held power tool according to the invention.

A particularly inexpensive form of the vibration absorber unit—in particular of the at least one vibration absorbing element—is achieved by embodying it/them in the form of at least one vibration absorbing mass.

A particularly advantageous modification of the hand-held power tool according to the invention is produced by coupling the vibration absorber unit to a forced excitation device that is able to drive the at least one vibration absorbing element. In this case, the forced excitation device cooperates with the drive unit and/or output. This advantageously makes it possible to adapt the action of the vibration absorber unit to the operating state of the hand-held power tool.

A structurally simple and at the same time, particularly flexible embodiment of the forced excitation device has at least one fluid-filled pressure chamber and at least one actuating element. The at least one vibration absorbing element is set into motion by pressure changes in the fluid that act on the actuating element.

The fluid can be a gas, in particular air, for example, or also a liquid, in particular oil.

When a gas is used, the forced excitation device acts on the actuating element in an elastic fashion due to the compressibility.

By contrast, when a liquid is used, the movement of the at least one vibration absorbing element is damped particularly well.

In an advantageous embodiment, the actuating element and the mobile vibration absorbing element are attached to, in particular of one piece with, each other.

A damping of the vibration absorber unit can be achieved in a particularly simple way by means of a damping device. In a preferred embodiment, the damping device is equipped with a fluid path and at least one throttle. In addition, the damping device has at least one actuating element connected to the at least one vibration absorbing element.

In a particularly inexpensive form, the actuating element and the at least one vibration absorbing element are attached to, in particular of one piece with, each other.

A particularly effective embodiment of a vibration absorber unit according to the invention has at least one return element. The return element produces a return force acting on the at least one mobile vibration absorbing element. This return force defines a rest position of the mobile vibration absorbing element.

Advantageous embodiments of the at least one return element have at least one translatory and/or rotatory degree of freedom.

A structurally simple embodiment of a return element is achieved when produced in the form of at least one spring element.

In another preferred embodiment, the return element according to the invention has at least one damping element. Through the action of the damping element, the movement of the at least one vibration absorbing element can be advantageously damped, particularly in boundary regions.

A particularly compact design of a hand-held power tool according to the invention is achieved by situating the vibration absorber unit in a machine housing encompassing the drive unit and/or output and/or in a handle connected to this machine housing.

An advantageous method for damping oscillations in a hand-held power tool is characterized by the placement of a vibration absorber unit having at least one mobile vibration absorbing element with at least one degree of freedom of movement in such a way that the degree of freedom of movement encloses at least one angle W1 not equal to zero with the line of action of a drive unit and/or output of the hand-held power tool.

BRIEF DESCRIPTION OF THE DRAWINGS

Exemplary embodiments of the invention are shown in the drawings and will be explained in detail in the subsequent description in conjunction with the drawings, in which.

DESCRIPTION OF THE PREFERRED EMBODIMENT

Figure 1:
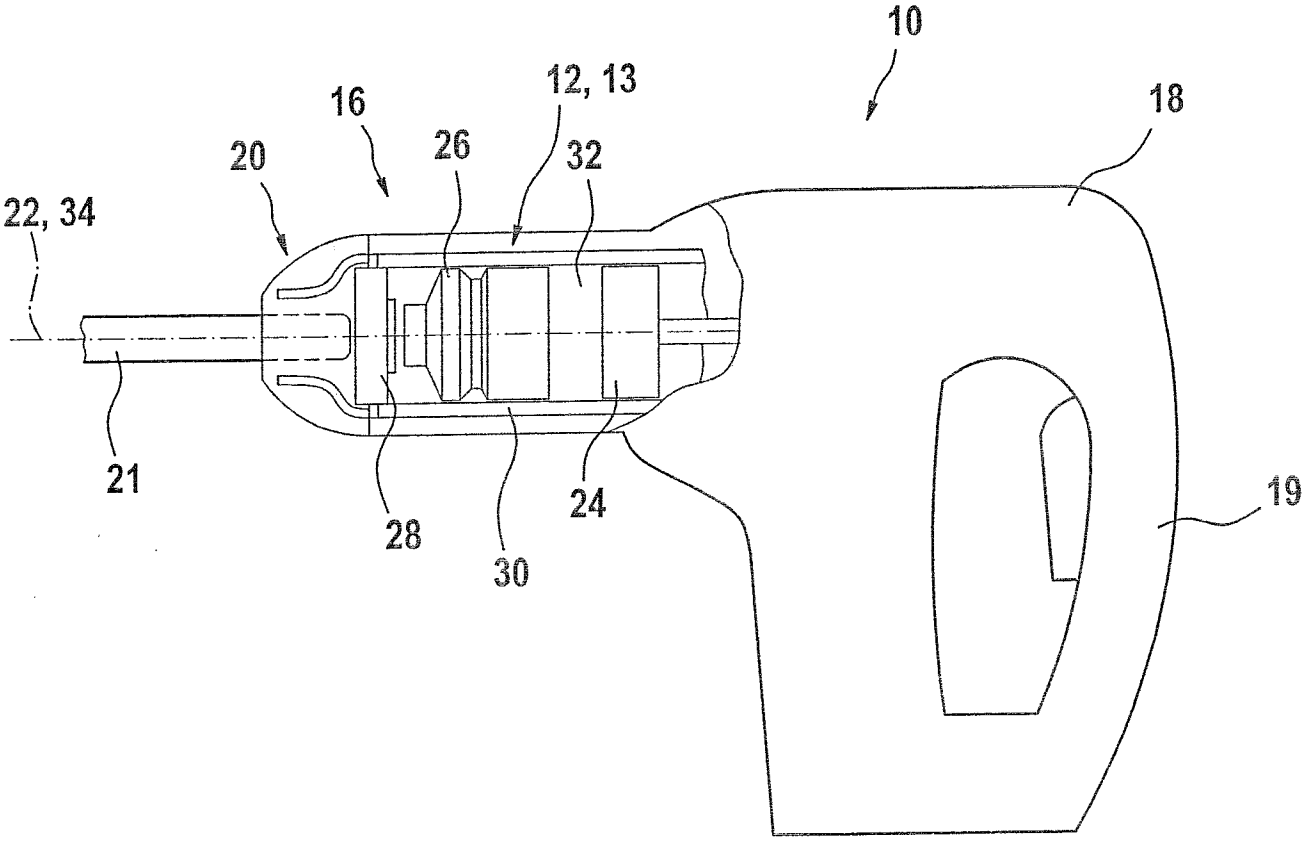
FIG. 1 shows a rotary hammer with an air-cushion impact mechanism according to the prior art, having a machine axis that is defined by the line of action of the impact mechanism.

FIG. 1 is a schematic depiction of a rotary hammer 10 of the kind known from the prior art, as an example of a hand-held power tool. The rotary hammer includes an impact mechanism 12, which in this case is embodied in the form of an air-cushion impact mechanism 13, for example, and a drive unit 14 that is not shown in detail. The air-cushion impact mechanism 13 is situated in a frontal housing region 16 of a machine housing 18. The machine housing 18 is also connected to at least one handle 19. A tool holder 20 is situated at the end surface of the frontal housing region 16. An insert tool 21 can be inserted into it. A variety of tool holders 20 are known from the literature and need not be discussed in detail here. The insert tool 21, in its longitudinal span, defines a machine axis 22. The air-cushion impact mechanism 13 is situated coaxially around this machine axis 22.

The air-cushion impact mechanism 13 in the present example includes an axially movable piston 24, an axially movable striking element 26, and an axially movable impact die 28. The piston 24, the striking element 26, and the impact die 28 are contained in a hammer tube 30. A drive unit 14 that is not shown in detail sets the piston 24 is set into a reciprocating oscillation in the hammer tube 30. By means of an air cushion 32 situated between the piston 24 and the striking element 26, the striking element 26 is in turn set into a reciprocating oscillation so that the striking element 26 is able to act in a hammering fashion on the impact die 28, which in turn is able to act on the insert tool 20.

During operation, the drive unit 14 and/or the air-cushion impact mechanism 13 and/or the insert tool 21 causes oscillations that propagate axially in the form of vibrations in the machine housing 18, chiefly along a line of action 34. This line of action 34 is preferably oriented parallel to the machine axis 22.

In addition to the above-outlined impact driving of the insert tool 21 by means of an impact mechanism 12, 13, known rotary hammers 10 also have a rotary drive of the tool holder 20 and the insert tool 21, which is coupled to the tool holder for co-rotation and is not shown in FIG. 1.

But oscillation modes also occur that are not parallel to this main oscillation axis 34. Consequently, there are known transverse oscillations oriented in various spatial directions, whose propagation direction depends, among other things, on the housing geometry, the distribution of mass, the individual drive concept, and other variables of the respective hand-held power tool.

During operation of the rotary hammer 10 in which the insert tool 21 is driven in rotary fashion, rotary oscillations occur in particular due to the recoiling of the insert tool 21 as it interacts with a work piece. These rotary oscillations preferably have a rotation axis that is oriented parallel to the machine axis. In this case, a rotation plane of the rotary oscillations is inclined at an angle W1 not equal to zero, preferably a right angle, in relation to the machine axis 22 or the line of action 34 of the impact mechanism 12.

In addition to these rotary oscillations, other oscillation modes can also occur. Particularly in hand-held power tools operated in an impact drilling mode such as rotary hammers or impact drills, the effective oscillations transmitted to the machine housing 18 comprise an overlapping of various oscillation modes, a non-negligible portion of said oscillations arising from oscillation modes that propagate in a direction not parallel to the line of action 34.

Figure 2A:
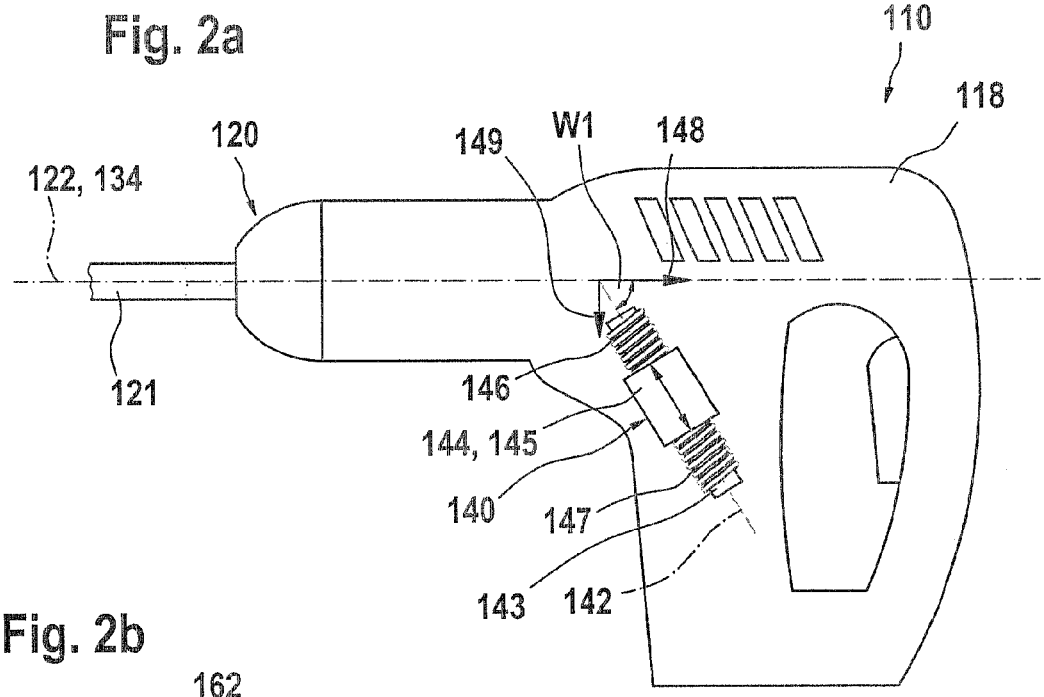
FIG. 2*a* shows a rotary hammer according to the invention, having a one-dimensional, translatory vibration absorber unit situated at an angle to the machine axis.

FIG. 2*a* is a schematic depiction of a hand-held power tool according to the invention, in particular a rotary hammer 110. In order to differentiate these reference numerals from those of the hand-held power tool according to the prior art shown in FIG. 1, they have all been augmented by 100. The rotary hammer 110 has a machine housing 118 and a tool holder 120 situated in the frontal housing region 116 of the machine housing 118. An insert tool 121 is inserted into the tool holder 120. This insert tool defines a machine axis 122 in a way analogous to the one in FIG. 1. Also analogous to the rotary hammer 10 known from FIG. 1, the rotary hammer 110 has an impact mechanism 112, 113, not shown, which establishes a line of action 134, and/or a rotary drive unit, not shown. The line of action 134 and the machine axis 122 here, as is already known from FIG. 1, are oriented parallel to each other. The hand-held power tool according to the invention is also equipped with a vibration absorber unit 140.

The vibration absorber unit 140 has a vibration absorption axis 142. The vibration absorption axis 142 here is embodied in the form of a vibration absorber guide rail 143. This vibration absorber guide rail 143 is preferably rigidly connected to the machine housing 118 and/or to at least one supporting element, not shown in detail, that supports internal machine components. This vibration absorption axis 142, 143 is inclined at an angle W1 not equal to zero in relation to the line of action 134.

The vibration absorber unit 140 includes at least one mobile vibration absorbing element 144, which has at least one degree of freedom of movement. Preferably, the mobile vibration absorbing element 144 is embodied in the form of a vibration absorbing mass 145. In the embodiments shown in FIGS. 2*a*-2*e*, the mobile vibration absorbing element 144 has at least one degree of freedom of translatory movement. Preferably, this is oriented along the vibration absorption axis 142, for example parallel or coaxial to it. In the present example, the mobile vibration absorbing element 144 is supported on the vibration absorber guide rail 143 in an axially movable fashion.

The mobile vibration absorbing element 144 is adjoined along the vibration absorption axis 142 by one, preferably two, return elements 146, 147. The return elements 146, 147 are supported at one end against the mobile vibration absorbing element 144 and at the other end against support surfaces or shoulders, not shown in detail, in the machine housing 118. In the form shown here, the return elements 146, 147 are embodied as compression springs.

The return elements 146, 147 cause the mobile vibration absorbing element 144 to return to a rest position. From this rest position, the mobile vibration absorbing element 144 is deflected by oscillation forces, which are induced among other things by oscillations occurring during operation of the hand-held power tool. By means of its inertia, the mass of the mobile vibration absorbing element 144 acts in a delaying fashion on the deflection from the rest position. This draws energy from the oscillations, thus reducing the oscillation energy transmitted to the machine housing 116. Since the vibration absorber unit 140 according to the invention performs its function by virtue of an inertia effect, it can also be referred to as a so-called inertial vibration absorber and in this specific embodiment, as a translatory inertial vibration absorber.

Through the orientation of the vibration absorber unit 140 that is out of parallel with the line of action 134 by the angle W1, it is possible to separate a movement along the vibration absorption axis 142 of the vibration absorbing element 144 into at least two movement components 148, 149. The first movement component 148 here is parallel to the line of action 134. The second movement component 149 is perpendicular to it.

During operation of the rotary hammer 110 according to the invention, if oscillations occur because of the drive unit 114 and/or the impact mechanism 112, 113 and/or the insert tool 121, then the mobile vibration absorbing element 144, thanks to its inertia, exerts a damping action on the oscillation amplitudes. Through the orientation of the vibration absorber unit 140 according to the invention, it is possible to damp oscillation modes that propagate parallel to the at least two movement components 148, 149 of the mobile vibration absorbing element 144.

Figure 2B:
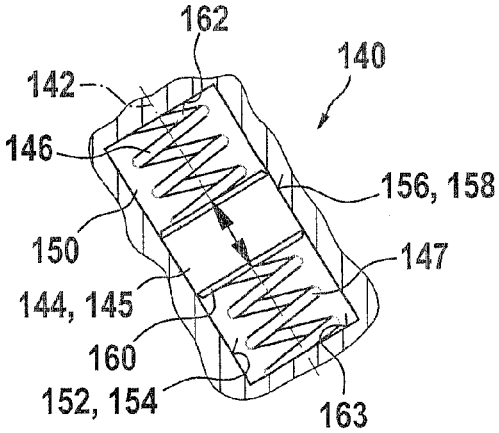
FIGS. 2*b* through 2*e* show examples of one-dimensional, translatory vibration absorber units.

FIG. 2*b* shows a modified embodiment of a vibration absorber unit 140 according to the invention. The mobile vibration absorbing element 144 here is contained in a vibration absorber housing 150 and is able to move along a vibration absorption axis 142. This embodiment eliminates a vibration absorber guide rail 143. Analogous to the connection of the vibration absorber guide rail 143 known from FIG. 2*a*, the vibration absorber housing 150 is rigidly connected to the machine housing 118 and/or to at least one supporting element, not shown in detail, that supports internal machine components. On its inner circumference surface 152, the vibration absorber housing 150 has guide means 154 that are not shown in detail. On its outer circumference surface, the mobile vibration absorbing element 144 has guide elements 158, not shown here, that fit together with the guide means 154.

As is already known from the preceding exemplary embodiments, return elements 146, 147 are situated along the vibration absorption axis 142 in such a way that they are able to hold the mobile vibration absorbing element 144 in its rest position or return it to this rest position. To that end, the return elements 146, 147 are each supported at one end against a respective end surface 160 of the mobile vibration absorbing element 144. The inner end surfaces 162, 163 of the vibration absorber housing 150 each serve as a respective second abutting support.

The operation of this embodiment corresponds to the embodiment of a translatory inertial vibration absorber known from FIG. 2*a*. This embodiment permits a particularly simple manufacture in the form of a preassembled unit.

In a preferred embodiment, the mobile vibration absorbing element 144 also has suitable bevels 160 at the edges between the outer circumference surface 156 and the end surfaces. During a movement of the vibration absorbing element 144, these bevels 160 prevent it from tilting in the vibration absorber housing 150.

In another preferred variant—not shown here—of the exemplary embodiment from FIG. 2*b*, the vibration absorbing element 144 is embodied in the form of a ball. This embodiment eliminates the need for providing the circumference surfaces 152, 156 with either guide means 154, 158 or bevels 160.

Figure 2C:
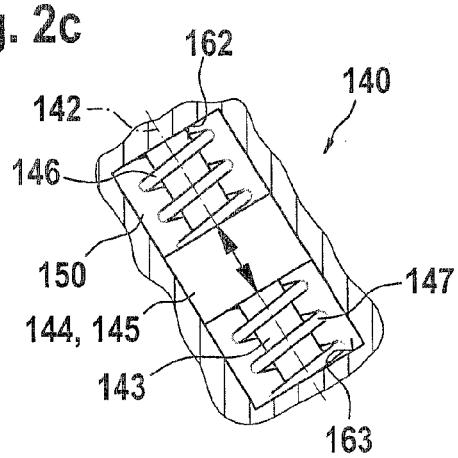

FIG. 2*c* shows another variant of a vibration absorber unit 140 according to the invention, which is a combination of the examples already known from FIGS. 2*a* and 2*b*. This vibration absorbing element 140 also has a vibration absorber housing 150 that encloses the mobile vibration absorbing element 144. In this case, the vibration absorbing element 144 is supported in movable fashion on a vibration absorber guide rail 143 oriented along a vibration absorption axis 142. As is known from FIG. 2*a*, in addition to the vibration absorbing element 144, preferably two return elements 146, 147 are provided. The support of the return elements 146, 147 here is identical to the one known from FIG. 2*b*.

The operation of this embodiment corresponds to the above-described exemplary embodiments of a translatory vibration absorber.

Figure 2D:
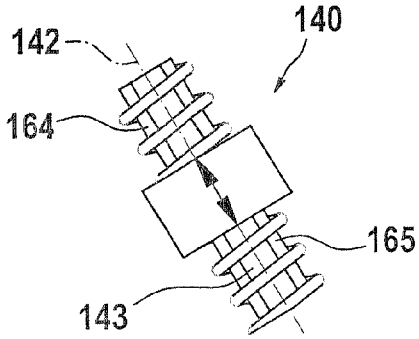

FIG. 2*d* shows a modification of the exemplary embodiment known from FIG. 2*a*, with at least one, preferably two, damping elements 164, 165 abutting the vibration absorbing element 144 and arranged along the vibration absorption axis 142.

The operation of this embodiment is similar to the exemplary embodiments described above. The damping elements 164, 165, however, exert a damping action on a deflection of the vibration absorbing element 144 from its rest position. In this case, damping elements 164, 165 that are in particular elastically embodied can either function directly as return elements 146, 147 or, as depicted, can be supplemented by additional return elements 146, 147.

Naturally, the damping elements 164, 165 can also be used in a function-enhancing way in other embodiments of the vibration absorber unit 140 according to the invention, e.g. the ones known from FIGS. 2*b* and 2*c*.

Figure 2E:
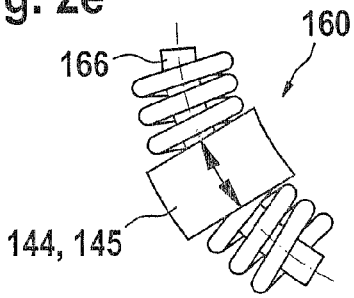

Another improvement of a vibration absorber unit 140 according to the invention is depicted in FIG. 2*e*. In this case, the mobile vibration absorbing element 144 is situated on a curved vibration absorber guide rail 166. The mobile vibration absorbing element 144 is supported so that it is able to move along the curved vibration absorber guide rail 166. Through a suitable selection of the curvature of the curved vibration absorber guide rail 166, it is possible for the oscillation-damping behavior of the vibration absorber unit 140—in terms of the movement components 148, 149—to be adapted to apparatus-related and/or operational peculiarities of the hand-held power tool. Otherwise, the operation of this embodiment corresponds to the exemplary embodiment of a translatory vibration absorber known from FIG. 2*a*.

Modifications and improvements of the vibration absorber unit 140 according to the invention are particularly possible by combining the features described above.

Furthermore, the person skilled in the art will find other modifications by means of alternative return elements such as sheet-metal springs, corrugated springs, spring circlips, rod springs, air springs, and other types of spring-elastic elements.

The damping elements 164, 165 can also yield various embodiments, improvements, and modifications of a vibration absorber unit 140 according to the invention. The person skilled in the art is familiar with a wide variety of damping elements.

Other modifications are produced based on the specific design of the mobile vibration absorbing element 144. In particular, the mobile vibration absorbing element 144 can be composed of two parts, three parts, or multiple parts. It is also possible to embody the geometric design of the mobile vibration absorbing element 144 in a way that differs from the form shown here. Thus in addition to block-shaped, it is also possible to use cylindrical, conical, and partially conical designs, as well as other designs based on combinations of geometric figures.

A multitude of embodiments can also be found in the design of the support and guidance of the vibration absorbing element 144 on the vibration absorber guide rail 143, 166 and in the vibration absorber housing 150. It is thus possible to provide multi-beam vibration absorber guide rails 143, 166. In addition, the vibration absorbing element 144 in the vibration absorber housing 150 can be guided over the entire area of the circumference surfaces 152, 156 functioning as guide surfaces or can be only partially guided with suitable guide means 154, 158.

Figure 3A:
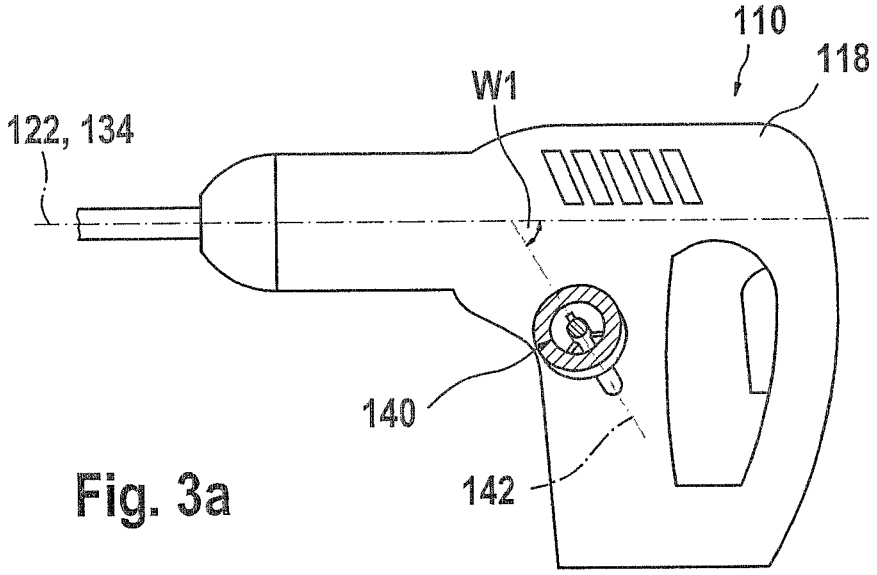
FIG. 3*a* shows a rotary hammer according to the invention, having a vibration absorber unit situated at an angle to the machine axis and equipped with a central suspension.

FIG. 3*a* schematically depicts another exemplary embodiment of a hand-held power tool according to the invention. The rotary hammer 110 shown by way of example, as is known from the preceding one, has a machine axis 122 extending through the machine housing 118 and parallel to it, a line of action 134. The machine housing 118 contains a vibration absorber unit 140, which has a vibration absorption axis 142 that is inclined in relation to the line of action 134 by an angle W1 that is not equal to zero.

Figure 3B:
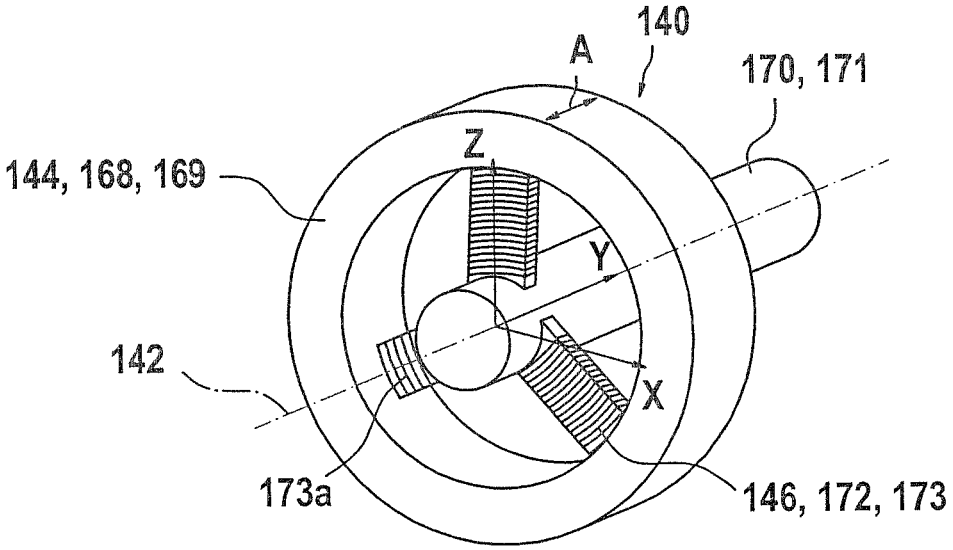
FIG. 3*b* shows an example for a one-dimensional, translatory vibration absorber unit with a central suspension.

FIG. 3*b* is an enlarged, schematic depiction of the vibration absorber unit 140 known from FIG. 3*a*. In this embodiment, the mobile vibration absorbing element 144 is embodied as a hollow element 168, in particular a vibration absorbing ring 169. The mobile vibration absorbing element 144, 168, 196 is situated around a supporting element 170. In the present form, the supporting element 170 is embodied as a central supporting rod 171. Analogous to the connection of the vibration absorber guide rail 143 known from FIG. 2*a*, during assembly, the vibration absorber unit 140 according to the invention is connected, preferably rigidly, to the machine housing 118 and/or to at least one supporting element, not shown in detail, that supports internal machine components.

The vibration absorbing element 144, 168, 169 is connected to the supporting element 170, 171 by means of three elastic connecting elements 172 that function as return elements 146. The elastic connecting elements 172 here are distributed around the circumference of the supporting element 170, 171, spaced apart from one another by uniform angular distances. In a preferred embodiment, the elastic connecting elements 172 are embodied in the form of sheet-metal springs 173.

The arrangement of one spring side 173*a* of the sheet-metal spring 173 oriented parallel to the plane of the ring—corresponds to the XZ plane—according to FIG. 3*b* gives the mobile vibration absorbing element 144, 168, 169 at least one degree of freedom of movement that is oriented chiefly parallel to the vibration absorption axis 142. By varying the strength of the sheet-metal springs 173, it is possible to also achieve a non-parallel component of the degree of freedom.

This degree of freedom is of a translatory nature in relation to the vibration absorption axis 142 and is referred to below by the letter A.

A vibration absorber unit 140 according to the invention embodied in this way corresponds in function to the embodiments of a translatory inertial vibration absorber known from FIGS. 2*a* through 2*e*.

Figure 4A:
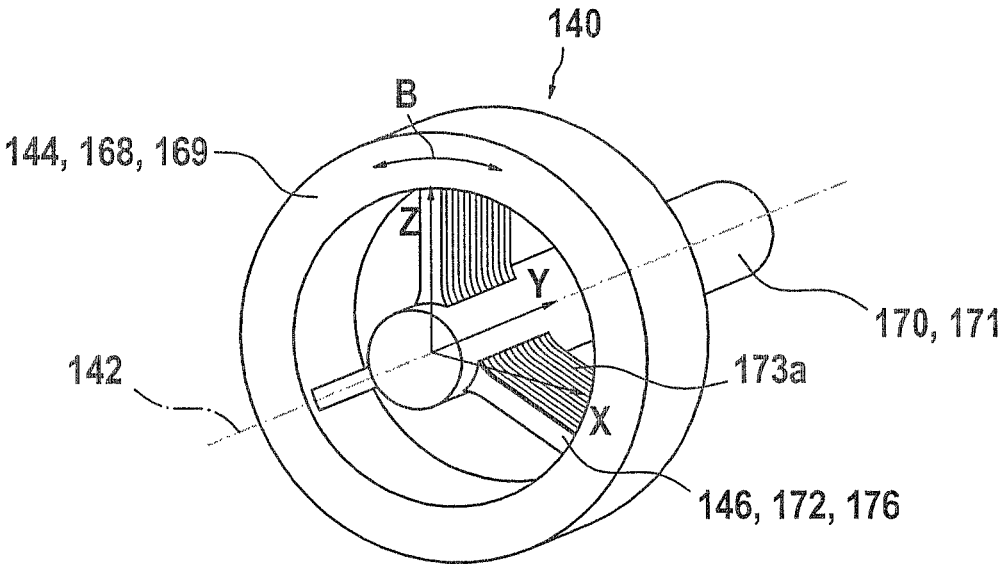
FIG. 4*a* shows a variant of the vibration absorber unit known from FIG. 3*b*, embodied in the form of a one-dimensional, rotatory vibration absorber unit.

FIG. 4*a* shows a modified embodiment of the vibration absorber unit 140 according to the invention already known from FIG. 3*b*. In this embodiment, the spring side 173*a* of the sheet-metal spring 173 is oriented parallel to the vibration absorption axis 142. This orientation gives the mobile vibration absorbing element 144, 168, 169 a predominantly rotatory degree of freedom B around the vibration absorption axis 142.

The mobile vibration absorbing element 144 can be deflected from its rest position in one of the rotation directions by oscillation forces that are in particular induced by means of rotatory oscillation modes. If the deflection occurs due to an inertial moment of the mobile vibration absorbing element 144, the excitation by the oscillation forces is delayed. The sheet-metal springs 173 once again exert a returning action on the mobile vibration absorbing element 144, causing it to rotate back into its rest position. The vibration absorber unit 140 therefore exerts a predominantly damping action on rotational or torsional oscillations that propagate in particular parallel to the vibration absorption axis 142 in the machine housing 118. The inertial vibration absorber designed in this way is referred to below as a rotatory inertial vibration absorber. The plane of action of a rotatory inertial vibration absorber is thus parallel to the rotation plane of the mobile vibration absorbing element 144.

Figure 4B:
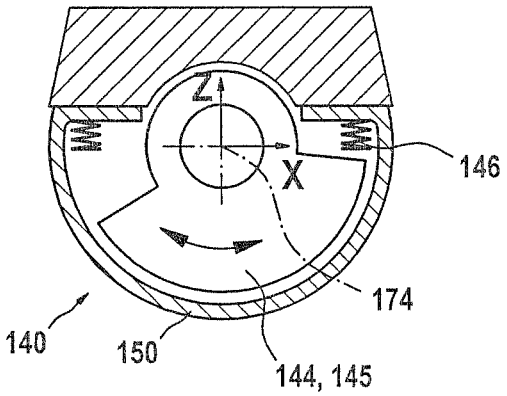
FIG. 4*b* shows an alternative embodiment of a one-dimensional, rotatory vibration absorber unit.

FIG. 4*b* shows an alternative embodiment of a vibration absorber unit 140 according to the invention in the form of a rotatory inertial vibration absorber. This vibration absorber unit 140 has a vibration absorber housing 150, which contains the mobile vibration absorbing element 144 and serves to fasten the vibration absorber unit 140 in or to the machine housing 118. In this embodiment, the mobile vibration absorbing element 144 is embodied in the form of an eccentric vibration absorbing mass 145 situated around a vibration absorber rotation axis 174 and supported so that it is able to rotate freely around this axis. A center of mass M of the mobile vibration absorbing element 144, 145 is situated eccentric to the vibration absorber rotation axis 174. In a rotation plane that corresponds to the XZ plane, a respective return element 146, 147 is situated in each of the two rotation directions; in FIG. 4*b*, the return elements are connected to the vibration absorber housing 150, only loading the mobile vibration absorbing element 144, 145 in its end positions. In this way, when deflected from its rest position by oscillation forces, the mobile vibration absorbing element 144, 145 can absorb a relatively large amount of energy before the return elements 146, 147 cause the mobile vibration absorbing element 144, 145 to return to this rest position.

Advantageous improvements and modifications of this embodiment of a rotatory inertial vibration absorber are possible, among other things, by adapting the form and design of the return elements 146, 147. Thus it can be advantageous for the return elements 146, 147, analogous to the embodiments of a translatory inertial vibration absorber known from FIGS. 2*a* through 2*e*, to be embodied as compression springs that are supported between end surfaces of the mobile vibration absorbing element 144, 145 and inner support surfaces of the vibration absorber housing 150. It can also be advantageous, analogous to FIG. 2*d*, for the return elements 146, 147 to be replaced or supplemented with damping elements.

Figure 4C:
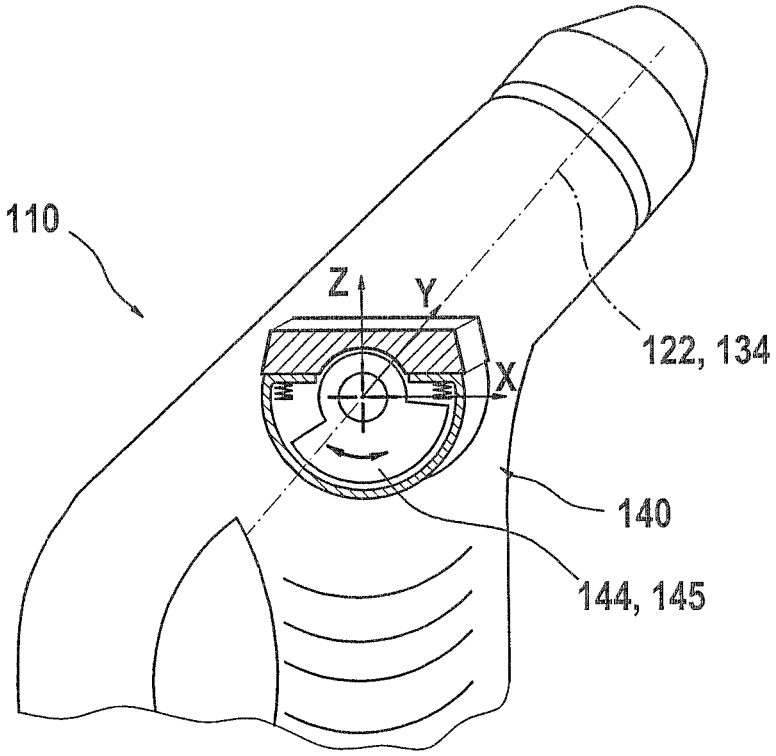
FIG. 4*c* shows a rotary hammer according to the invention, having a one-dimensional, rotatory vibration absorber unit with a rotation plane XZ that is inclined in relation to the line of action.

FIG. 4*c* is a three-dimensional schematic depiction of an alternative embodiment of a hand-held power tool according to the invention, embodied in the form of a rotary hammer 110 that is equipped with a vibration absorber unit 140 embodied in the form of a rotatory inertial vibration absorber according to FIG. 4*b*. In this embodiment, the vibration absorber unit 140 is situated so that the vibration absorber rotation axis 174 is oriented parallel and preferably coaxial to the line of action 134. The plane of action of the rotatory degree of freedom—corresponds to the XZ plane—of the vibration absorber unit here is inclined at an angle not equal to zero, preferably a right angle, in relation to the line of action 134.

In an analogous fashion, other embodiments of a rotatory inertial vibration absorber, as are known from FIG. 4*a*, for example, can also be provided in a hand-held power tool according to the invention.

Figure 5A:
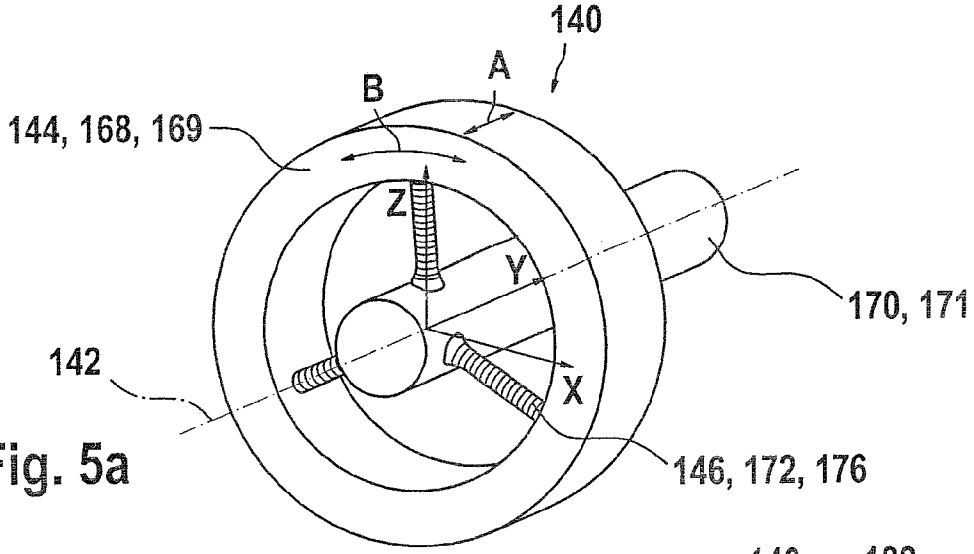
FIG. 5*a* shows an example of a two-dimensional vibration absorber unit with a translatory and rotatory degree of freedom.

FIG. 5*a* shows another preferred embodiment of a vibration absorber unit 140 according to the invention. This embodiment of an inertial vibration absorber represents a modification of the variants known from FIGS. 3*b* and 4*a*. In this embodiment, the elastic connecting elements 172 are embodied in the form of rod springs 176. The rod springs 176 are in particular elastic both parallel to the plane of the ring—corresponds to the XZ plane—of the mobile vibration absorbing element 144, 168, 169 and in the radial planes in relation to the vibration absorption axis 142. The vibration absorbing element 144, 168, 169 has at least two degrees of freedom of movement A and B, where A represents a translatory degree of freedom parallel to the vibration absorption axis 142 and B represents a rotatory degree of freedom parallel to the plane of the ring of the vibration absorbing element 144, 168, 169. In its operation, this embodiment corresponds to a superimposition of the embodiments already known from FIGS. 3*b* and 4*a*. Such a vibration absorber unit 140 according to the invention is particularly suitable for damping both transverse and rotatory oscillation modes. It can thus be referred to here as a dual-mode inertial vibration absorber.

In modifications of the vibration absorber unit 140 according to the invention, the mobile vibration absorbing element 144 can have, among others, a hollow cylindrical, toroidal, or other hollow body form. By contrast with the embodiments shown in the detailed view, it is also possible for the mobile vibration absorbing element 144 to be composed of two parts, three parts, or multiple parts.

In the specific embodiment, the number of connecting elements 172 can vary between at least one, but preferably two, three, or a plurality, which incidentally also applies to all variants according to FIGS. 3*b*, 4*a*, and 5*a*. The connecting elements 172 can also be produced from different elastic materials such as spring steel, sheet metals, or plastics. It can also be advantageous to embody the connecting elements in the form of damping elements 164 or to supplement them with damping elements 164.

Other variants of inertial vibration absorbers according to FIGS. 3*b*, 4*a*, and 5*a* arise from different embodiments of the supporting element 170. When embodied as a holding rod 171, the supporting element 170 can diverge from the cylindrical form shown here, in particular it is also conceivable for it to have a triangular, square, or other polygonal cross section. In addition, the supporting element 170 can be composed of two or more parts.

Figure 5B:
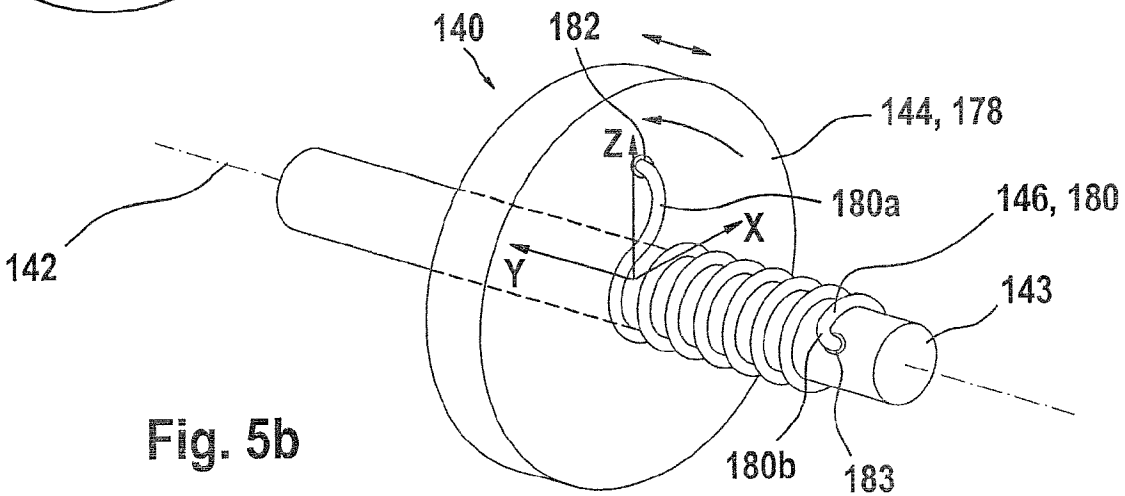
FIG. 5*b* shows an alternative embodiment of a two-dimensional vibration absorber unit with a translatory and rotatory degree of freedoms.

FIG. 5*b* schematically depicts the embodiment of a vibration absorber unit 140 according to the invention in the form of an alternative dual-mode inertial vibration absorber. The vibration absorber unit 140 has a vibration absorber guide rail 143, which extends along the vibration absorption axis 142 and a mobile vibration absorbing element 144. The mobile vibration absorbing element 144 is supported in an axially movable fashion on the vibration absorber guide rail 143 and is able to rotate around it. The mobile vibration absorbing element 144 here is embodied in the form of an annular disk 178, for example.

The vibration absorber guide rail 143 and the mobile vibration absorbing element 144 are operationally connected to each other by means of a return element 146. The return element 146 here is embodied in the form of a helical spring 180 situated around the vibration absorber guide rail 143.

At its end oriented toward the mobile vibration absorbing element 144, the helical spring 180 has an extension 180*a* that points radially outward and is equipped with an insertion pin. With this insertion pin, the helical spring 180 engages in a receiving bore 182 in the vibration absorbing element 144, 178. At its other end, the helical spring 180 has a securing pin 180*b* oriented radially inward, which is inserted into a receiving bore 183 of the vibration absorber guide rail 143.

This suspension gives the vibration absorber unit 140 according to the invention two degrees of freedom A and B, where A represents a translatory degree of freedom parallel to the vibration absorption axis 142 and B represents a rotatory degree of freedom in a rotation plane that corresponds to the XZ plane around the vibration absorber guide rail 143. Such a vibration absorber unit 140 according to the invention is particularly suitable for damping both transverse and rotatory oscillation modes.

In one variant of the vibration absorbing element 140 according to the invention, two or more return elements 146 are provided.

In a preferred variant of the vibration absorbing element 140 according to the invention, the vibration absorber guide rail 143 and the vibration absorbing element 144, 178 are operationally connected to each other by means of at least one, but preferably two, three, or more damping elements 164. The damping element 164 here can exert a damping action on a translatory and/or rotatory movement of the vibration absorbing element 144, 178.

Other variations ensue from different fastening designs for connecting the vibration absorber guide rail 143 and/or vibration absorbing element 144, 178 to the return element 146 and/or the damping element 164.

Additional modifications ensue from the embodiment of the mobile vibration absorbing element 144, which can, for example, have a polygonal, elliptical, or other outer contour. In addition, the mobile vibration absorbing element 144 can be composed of two parts, three parts, or multiple parts.

Figure 6:
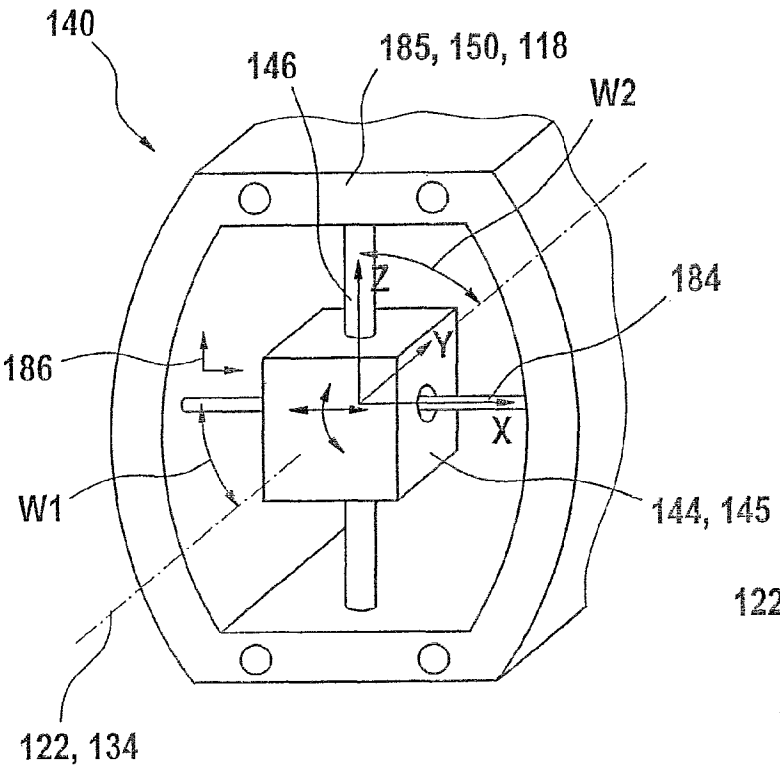
FIG. 6 shows another example of a two-dimensional vibration absorber unit.

FIG. 6 shows a modified embodiment of a vibration absorber unit 140 in the form of an inertial vibration absorber. In this case, the vibration absorber unit 140 includes a mobile vibration absorbing element 144 embodied in the form of a vibration absorbing mass 145. The mobile vibration absorbing element 144, 145 is situated on a vibration absorber rotation axis 184, which is positioned in a transverse extension of a housing 185 and is connected to the housing 185. The housing 185 can be either a vibration absorber housing 150 or the machine housing 118 itself The mobile vibration absorbing element 144, 145 is rotatable in a transverse extension and is supported in axially movable fashion on the vibration absorber rotation axis 184. The vibration absorber rotation axis 184 here is oriented at an angle W1 not equal to zero in relation to the machine axis 122 and to the line of action 134 of an impact mechanism that is not shown. Together with at least one, preferably two, return elements 146, the vibration absorber rotation axis 184 spans a vibration absorber plane 186, which is oriented at an angle W2, for example a right angle, to the machine axis 122 and to the line of action 134 of an impact mechanism that is not shown.

The return elements 146 operationally connect the mobile vibration absorbing element 144, 145 to the housing 185; the return elements 146 are situated in the vibration absorber plane 186, preferably perpendicular to the vibration absorber rotation axis 184.

In a preferred embodiment, the return elements 146 are embodied as sheet-metal springs, spring bands, or helical springs. The mobile vibration absorbing element 144, 145 thus has at least two degrees of freedom A and B, where A represents a translatory degree of freedom along the vibration absorber rotation axis 184 and B represents a rotatory degree of freedom around this axis. In particular, because of the orientation of the vibration absorber rotation axis 184, the degree of freedom A encloses an angle W1 not equal to zero with the machine axis 122 and the line of action 134 of an impact mechanism, not shown.

Such a vibration absorber unit 140 exerts an in particular damping action on transverse oscillations parallel to the vibration absorber rotation axis 184 and torsional oscillations perpendicular to the vibration absorber plane 186.

Variations of this embodiment ensue, among other things, from different geometrical embodiments of the mobile vibration absorbing element 144, 145, which particularly in addition to the block shape shown, can be embodied in the form of a ball, an ellipsoid, or other shapes. It is also possible for the vibration absorbing element 144, 145 to be composed of two parts, three parts, or multiple parts. In addition, the vibration absorber unit 140 can be embodied in the form of a preassembled unit in a separate support frame. In a preferred modification of the vibration absorber unit 140, it has at least one, but preferably two, three, or more damping elements 164, which exert a damping action on the deflections in the various degrees of freedom of the vibration absorbing element 144, 145.

Figure 7:
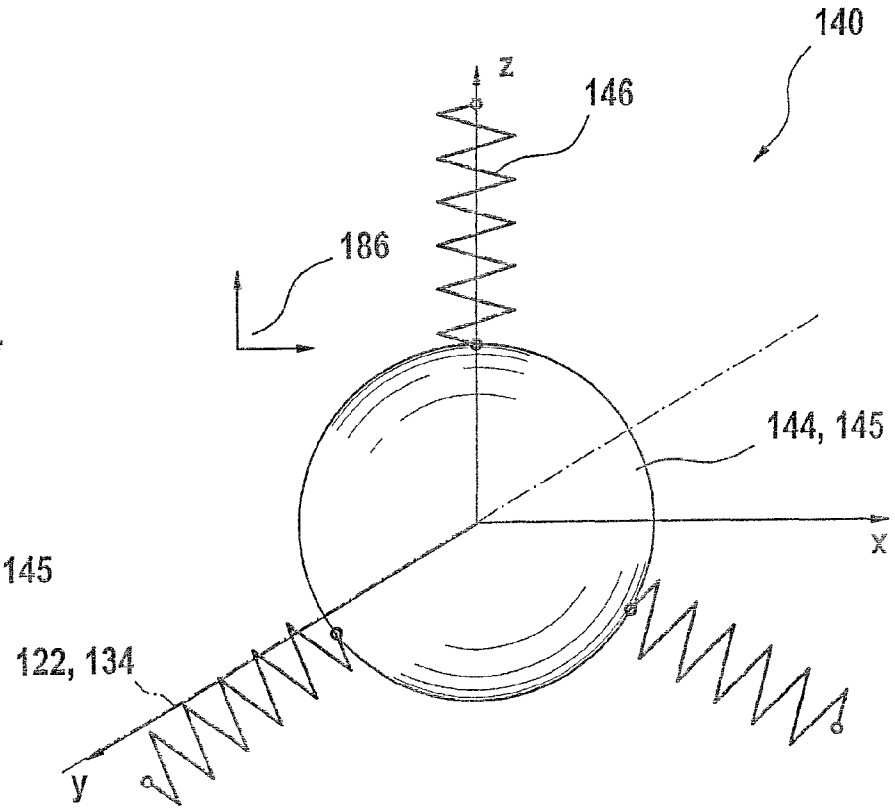
FIG. 7 shows an example of a multi-dimensional vibration absorber unit embodied in the form of a three-dimensional oseillator.

The modified embodiment of a vibration absorber unit 140 shown in FIG. 7 is embodied here in the form of a three-dimensional oscillator. The vibration absorber unit 140 here has a mobile vibration absorbing element 144 and three return elements 146. The return elements 146 are situated in a vibration absorber plane 186, each with one end connected to the vibration absorbing element 144 and preferably spaced apart from one another by uniform angular distances. With their opposite respective ends, the return elements 146 are each connected to the machine housing 118, not shown here.

In the rest state, the return elements 146 hold the mobile vibration absorbing element 144 in a rest position situated in the vibration absorber plane 186. The suspension of the vibration absorbing element 144 gives it a total of six degrees of freedom of movement; three degrees of freedom permit transverse oscillations parallel to the main axes x, y, z and another three degrees of freedom permit rotational oscillations around these main axes. Depending on the orientation of the vibration absorber plane 186 in relation to the machine axis 122 and the line of action 134 of an impact mechanism not shown, at least two translatory degrees of freedom are inclined in relation to this plane by an angle that is not equal to zero.

In a preferred modification of the vibration absorber unit 140, at least one, but preferably two, three, or more damping elements 164 can be provided, which exert a damping action on the deflection in the various degrees of freedom of the mobile vibration absorbing element 144. Variations of the vibration absorber unit 140 ensue, among other things, from the embodiment of the mobile vibration absorbing element 144, which particularly in addition to the ball shape shown, can be embodied in the form of a block, an ellipsoid, or other shapes. It is also possible for the vibration absorbing element 144 to be composed of two parts, three parts, or multiple parts. In addition, the vibration absorber unit 140 can be embodied in the form of a preassembled unit in a separate support frame.

Figure 8A:
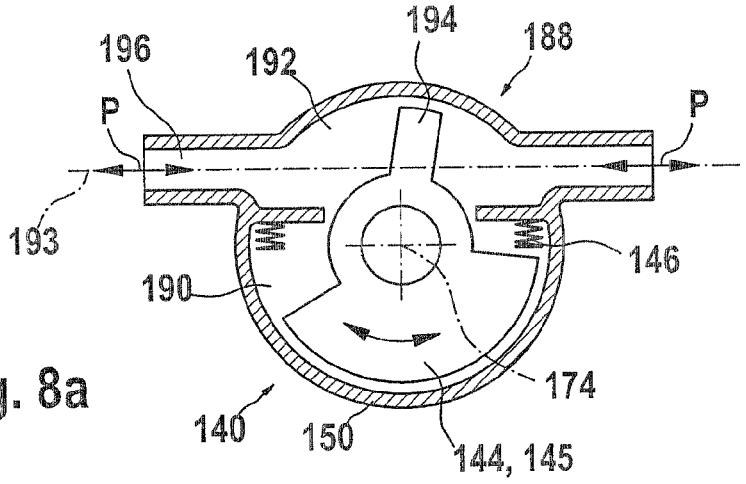
FIG. 8*a* shows an example of a forced excitation-equipped vibration absorber unit.

FIG. 8*a* shows a modification of the vibration absorber unit 140 already known from FIG. 4*b*, supplemented by a forced excitation device 188. The vibration absorber unit 140 has a vibration absorber housing 150 in which the mobile vibration absorbing element 144 and two return elements 146 are situated. The vibration absorber housing 150 includes a semicircular rotary oscillation chamber 190 and a pressure chamber 192. The mobile vibration absorbing element 144 is supported in rotary fashion around a vibration absorber rotation axis 174 and together with a vibration absorbing mass 145, is accommodated in the rotary oscillation chamber 190. The return elements 146 are fastened to the dividing wall passing approximately through the center of the housing and are oriented toward the vibration absorbing mass 145. The return elements 146 return the mobile vibration absorbing element 144 to a rest position.

At its end oriented into the pressure chamber 192, the mobile vibration absorbing element 144 has an actuating element 194. The actuating element 194 here, particularly in the rest position of the mobile vibration absorbing element 144, protrudes approximately perpendicular to an alignment line 193 established by two line connections 196 that are formed onto the upper region of the vibration absorber housing 150.

Figure 8B:
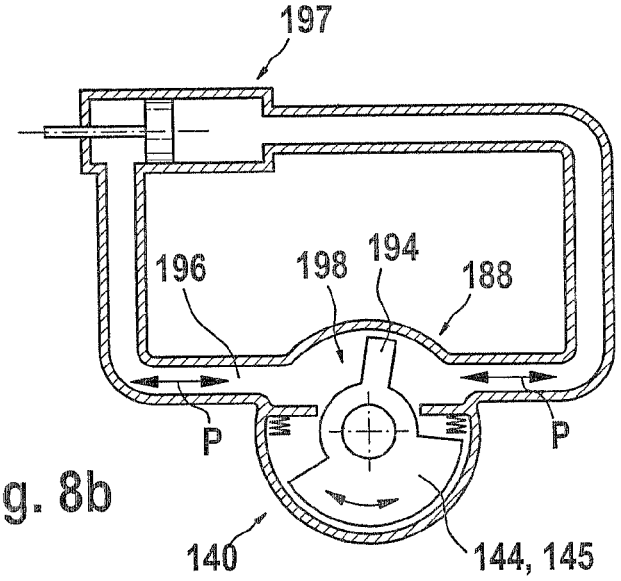
FIG. 8*b* is a schematic depiction of a forced excitation of a vibration absorber unit according to FIG. 8*a*.

FIG. 8*b* schematically depicts a connection of the vibration absorbing element 140 according to the invention to a forced excitation device 188. At the two line connections 196, the pressure chamber 192 is connected via a line system to a pressure source 197 operationally connected to the drive unit and/or output. The pressure source 197 moves a fluid 198 that can flow into and out of the pressure chamber 192 via the line connections 196. The fluid 198 can be either a gas, in particular air, or a liquid, in particular hydraulic fluid.

If the pressure source is operationally connected to the impact mechanism 112, in particular the air-cushion impact mechanism 113, and preferably if it is comprised by the latter, then pressure fluctuations in the pressure chamber 192 act on the actuating element 194. The actuating element 194 drives the mobile vibration absorbing element 144 out of the rest position. The rotating movement of the vibration absorbing element 144 produces counter-oscillations with a frequency that is matched to the impact frequency off the impact mechanism 112, 113 so that oscillations are actively damped in the machine housing 118.

The integration of the vibration absorber unit 140 equipped with the forced excitation device 188 into a hand-held power tool is carried out according to the invention in accordance with the embodiments already known from FIGS. 2*a*, 3*a*, and 4*c*.

In a modification, the vibration absorbing element 140 has damping elements 164 in the rotary oscillation chamber 190. In particular, the rotary oscillation chamber 190 can be filled with a damping fluid, which damps the deflection of the mobile vibration absorbing element 144.

In another embodiment, the vibration absorbing element 140 can include a mobile vibration absorbing element 144, which is mounted in an axially movable fashion on a vibration absorber guide rail 143, which is in particular oriented parallel to the alignment line 193. In this embodiment, instead of the rotating movement, the vibration absorbing element 144 executes an axially oscillating movement.

In addition to the embodiment of a forced excitation device 188 described here, which follows the pressure transducer principle, it is also possible to use, among others, mechanical, electromechanical, and/or electromagnetic devices to drive the mobile vibration absorbing element 144. In this case, the corresponding devices in preferred embodiments can be operationally connected to the drive unit and/or output, in particular the impact mechanism 112, for example.

Figure 8C:
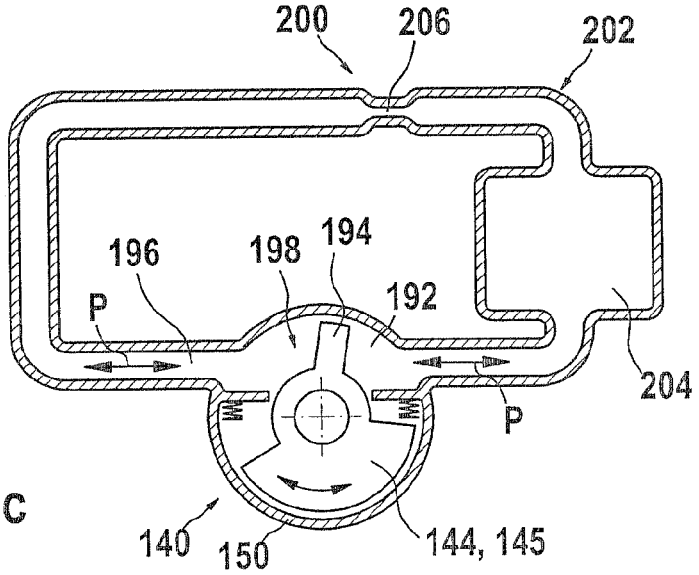
FIG. 8*c* is a schematic depiction of a damping circuit of a vibration absorber unit according to FIG. 8*a*.

Through a modification, the above-described exemplary embodiment of a vibration absorbing element 140 according to the invention can be equipped with a damping device 200 in lieu of a forced excitation device 188. FIG. 8*c* outlines this embodiment. To that end, instead of being connected to a pressure source, the line connections 196 are connected to a fluid reservoir 204 via a line connection functioning as a fluid path 202. In addition, at least one throttle 206 is provided in the fluid path 202. The fluid 198 in this embodiment functions passively. If the mobile vibration absorbing element 144 is set into motion due to inertial forces that can stem from oscillations in the machine housing 118, then the actuating element 194 functions as a damping piston, which is moved by the fluid 198.

In a preferred embodiment, the vibration absorbing element 140 according to the invention, together with the damping device 200, can be manufactured in the form of a preassembled module.

In a preferred modification of the vibration absorbing element 140 according to the invention equipped with the damping device 200, the at least one throttle 206 is embodied in the form of a variable throttle with an adjustable throttle cross-section; it is possible to provide a manual adjustment by the user through suitable adjusting means and/or an automated adjustment by means of a control unit. By adjusting the variable throttle, it is possible to adapt the damping behavior of the damping device 200 to the required degree.

Other advantageous embodiments of a vibration absorbing element 140 according to the invention can be achieved by combining features of the exemplary embodiments described above.

The specific embodiments of the individual features, which depend on the installation situation—in particular the connection to the machine housing 118, have no influence on the function of the vibration absorbing element 140 according to the invention. These therefore merely constitute adaptations of a vibration absorbing element 140 according to the invention.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool configured to drive a tool, comprising:

a machine housing defining an interior;

at least one drive unit disposed in the interior of the machine housing, the at least one drive unit coupled to the tool and configured to drive the tool along a line of action and in a rotary fashion with respect to the line of action, which produces linear oscillations along the line of action and rotary oscillations not parallel to the line of action; and at least one vibration absorber unit disposed in the interior of the machine housing and defining a vibration absorber unit axis, the vibration absorber unit axis being inclined with respect to the line of action so as to define an angle, the vibration absorber unit being equipped with at least one mobile vibration absorbing element in order to reduce the linear and rotary oscillations, the mobile vibration absorbing element moving along the vibration absorber unit axis.

2. The hand-held power tool as recited in claim 1, wherein the mobile vibration absorbing element, in addition to moving along the vibration absorber unit axis, has degrees of freedom of movement in three dimensions and with regard to rotation.

3. The hand-held power tool as recited in claim 2, wherein at least one degree of freedom of movement of the mobile vibration absorbing element corresponds to a transverse movement.

4. The hand-held power tool as recited in claim 1, wherein in addition to the vibration absorber unit axis, there is at least one degree of freedom of movement of the mobile vibration absorbing element which corresponds to a transverse movement.

5. The hand-held power tool as recited in claim 1, wherein the mobile vibration absorbing element is essentially embodied in the form of at least one vibration absorbing mass.

6. The hand-held power tool as recited in claim 1, wherein the vibration absorber unit also has at least one return element that produces a return force.

7. The hand-held power tool as recited in claim 6, wherein the return element has at least one translational or one rotational degree of freedom of movement.

8. The hand-held power tool as recited in claim 6, wherein the return element has at least one spring element.

9. The hand-held power tool as recited in claim 1, wherein the vibration absorber unit has at least one damping element.

10. The hand-held power tool as recited in claim 1, wherein the vibration absorber unit is situated in in a handle connected to this machine housing.

11. A method for damping oscillations in a hand-held power tool having at least one drive unit or output with at least one line of action, which produces at least oscillations along the line of action, and having at least one vibration absorber unit, in particular as recited according claim 1, the method having steps of:

reducing the oscillations with at least one mobile vibration absorbing element which has at least one degree of freedom of movement; and orienting the at least one degree of freedom of movement so that it encloses at least one angle not equal to zero and inclined with the line of action.

12. The hand-held power tool as recited in claim 1, wherein the inclined angle includes an angle configured to reduce the oscillations along the line of action and the rotary oscillations not parallel to the line of action.

13. The hand-held power tool as recited in claim 12, wherein the inclined angle is substantially a right angle with respect to the line of action.

14. The hand-held power tool as recited in claim 12 further comprising a supporting element disposed along the vibration absorber unit axis wherein the at least one mobile vibration absorbing element comprises a hollow element supported by a plurality of elastic connecting elements disposed between the hollow element and the supporting element.

15. The hand-held power tool as recited in claim 14 wherein the connecting elements are distributed around a circumference of the supporting element and spaced apart from one another by uniform angular distances.

* * * * *